US010650834B2

(12) United States Patent
Lee

(10) Patent No.: US 10,650,834 B2
(45) Date of Patent: May 12, 2020

(54) AUDIO PROCESSING METHOD AND NON-TRANSITORY COMPUTER READABLE MEDIUM

(71) Applicant: Savitech Corp., Hsinchu County (TW)

(72) Inventor: Ching-Hsiang Lee, Hsinchu County (TW)

(73) Assignee: Savitech Corp., Hsinchu County (TW)

( * ) Notice: Subject to any disclaimer, the term of this patent is extended or adjusted under 35 U.S.C. 154(b) by 277 days.

(21) Appl. No.: 15/867,674

(22) Filed: Jan. 10, 2018

(65) Prior Publication Data

US 2019/0214029 A1 Jul. 11, 2019

(51) Int. Cl.

| | |
|---|---|
| ***G10L 19/26*** | (2013.01) |
| ***G10L 19/02*** | (2013.01) |
| ***G10L 25/78*** | (2013.01) |
| ***G10L 19/012*** | (2013.01) |
| ***G10L 19/028*** | (2013.01) |
| *G10L 25/21* | (2013.01) |

(52) U.S. Cl.
CPC ..... *G10L 19/012* (2013.01); *G10L 19/0204* (2013.01); *G10L 19/028* (2013.01); *G10L 25/21* (2013.01)

(58) Field of Classification Search
CPC ... G10L 19/26; G10L 19/0017; G10L 10/012; G10L 19/02; G10L 25/78
See application file for complete search history.

(56) References Cited

U.S. PATENT DOCUMENTS

| | | | | | |
|---|---|---|---|---|---|
| 4,490,691 | A * | 12/1984 | Dolby | H03G 9/18 | 333/14 |
| 5,907,622 | A * | 5/1999 | Dougherty | H03G 3/32 | 381/108 |
| 6,041,227 | A * | 3/2000 | Sumner | H04M 3/533 | 379/88.1 |
| 7,009,533 | B1 * | 3/2006 | Wegener | H04N 1/413 | 341/76 |
| 7,039,194 | B1 * | 5/2006 | Kemp | G10K 15/02 | 381/103 |
| 7,394,410 | B1 * | 7/2008 | Wegener | H03M 7/30 | 341/50 |
| 10,461,712 | B1 * | 10/2019 | Yang | G10L 21/0316 | |

(Continued)

FOREIGN PATENT DOCUMENTS

| | | |
|---|---|---|
| CN | 104485112 A | 4/2015 |
| CN | 104541326 A | 4/2015 |

(Continued)

*Primary Examiner* — Olujimi A Adesanya
(74) *Attorney, Agent, or Firm* — CKC & Partners Co., LLC

(57) ABSTRACT

An audio processing method includes the following operation: dividing an audio file into a plurality of audio segments, in which a processing of a first audio segment of the audio segments includes the following operations: analyzing a first lowest energy value in a spectrum of the first audio segment; comparing the first minimum energy value with a preset energy value, and using a higher one as a first noise floor; generating a first processed audio segment according to the first noise floor and the first audio segment; compressing the first processed audio segment to produce a compressed audio segment; and sending the compressed audio segment to an audio playback device.

7 Claims, 10 Drawing Sheets

(56) References Cited

U.S. PATENT DOCUMENTS

| | | | | |
|---|---|---|---|---|
| 2008/0103710 | A1* | 5/2008 | Wegener | G01R 13/029 702/66 |
| 2009/0110208 | A1* | 4/2009 | Choo | G10L 21/038 381/71.1 |
| 2011/0022402 | A1 | 1/2011 | Engdegard et al. | |
| 2012/0259642 | A1 | 10/2012 | Takada | |
| 2013/0332176 | A1* | 12/2013 | Setiawan | G10L 19/0212 704/500 |
| 2014/0101485 | A1* | 4/2014 | Wegener | H03M 7/3068 714/32 |
| 2014/0149124 | A1* | 5/2014 | Choo | G10L 19/028 704/500 |
| 2015/0155842 | A1* | 6/2015 | Shuttleworth | H03G 7/002 381/98 |
| 2016/0260445 | A1* | 9/2016 | Duwenhorst | G06F 3/165 |
| 2018/0098149 | A1* | 4/2018 | Das | H03F 3/187 |

FOREIGN PATENT DOCUMENTS

| | | | |
|---|---|---|---|
| JP | 2011130240 | A | 6/2011 |
| TW | 201508738 | A | 3/2015 |
| TW | I536370 | B | 6/2016 |
| TW | 201637001 | A | 10/2016 |
| TW | 201717663 | A | 5/2017 |
| TW | I584271 | B | 5/2017 |
| TW | 201737244 | A | 10/2017 |
| WO | 2008100098 | A1 | 8/2008 |

* cited by examiner

AUDIO PROCESSING METHOD AND NON-TRANSITORY COMPUTER READABLE MEDIUM

FIELD OF INVENTION

The invention relates to a processing method. More particularly, the invention relates to a processing method and a non-transitory computer readable medium for compressing audio file.

BACKGROUND

Traditionally, if an audio file is to be transmitted to an audio playback device via a wireless transmission protocol that supports only a low-frequency bandwidth, such as Bluetooth, a distortion/lossy compression method such as MP3 format is configured to substantially reduce the amount of data. The distorted compression method may seriously cause the loss of low frequency and high frequency sound in the audio file, or reduce the original rich frequency or volume change, and greatly reduce the quality of the audio signal.

In addition, a general compression technique generally involves converting a voice file into a large number of operations such as conversion between a time domain and a frequency domain. However, a small-sized playback apparatus such as a Bluetooth headset, a Bluetooth speaker, or the like generally has only a microprocessor with a low processing capability. When performing decompression of audio files, these small-scale broadcast devices will take a long processing time and cannot be played instantly.

SUMMARY

An embodiment of this disclosure is to provide an audio processing method includes the following operation: dividing an audio file into a plurality of audio segments, in which a processing of a first audio segment of the audio segments includes the following operations: analyzing a first lowest energy value in a spectrum of the first audio segment; comparing the first minimum energy value with a preset energy value, and using a higher one as a first noise floor; generating a first processed audio segment according to the first noise floor and the first audio segment; compressing the first processed audio segment to produce a compressed audio segment; and sending the compressed audio segment to an audio playback device.

An embodiment of this disclosure is to provide a non-transitory computer readable medium storing a plurality of instructions, wherein when the instructions are executed by a processing unit, a plurality of operations as following are executed: dividing an audio file into a plurality of audio segments, wherein a processing of one of the audio segments comprises the following operations: analyzing a lowest energy value in a spectrum of the one of the audio segments; comparing the first minimum energy value with a preset energy value and using a higher one as a noise floor; generating a processed audio segment according to the noise floor and the one of the audio segments; compressing the processed audio segment to produce a compressed audio segment; and sending the compressed audio segment to an audio playback device.

An embodiment of this disclosure is to provide a non-transitory computer readable medium storing a plurality of instructions so as to restore a compressed audio segment in a compressed audio file, wherein when the instructions are executed by a processing unit, a plurality of operations as following are executed: decompressing the compressed audio segment to obtain a decompressed audio segment; and multiplying each of a plurality of sample values in the decompression audio segment by a discarded value; wherein the discarded value is related to an original noise floor of an original audio segment corresponding to the compressed audio segment.

Through the teachings of the disclosure, audio files may be transmitted over low bandwidth transmission protocols. Since the audio file is processed in an undistorted compression format, which does not involve, for example, the conversion between the time domain and the frequency domain, even if the audio playback device only has a processor with low computing power, the audio file may be decompressed quickly for instant playback.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
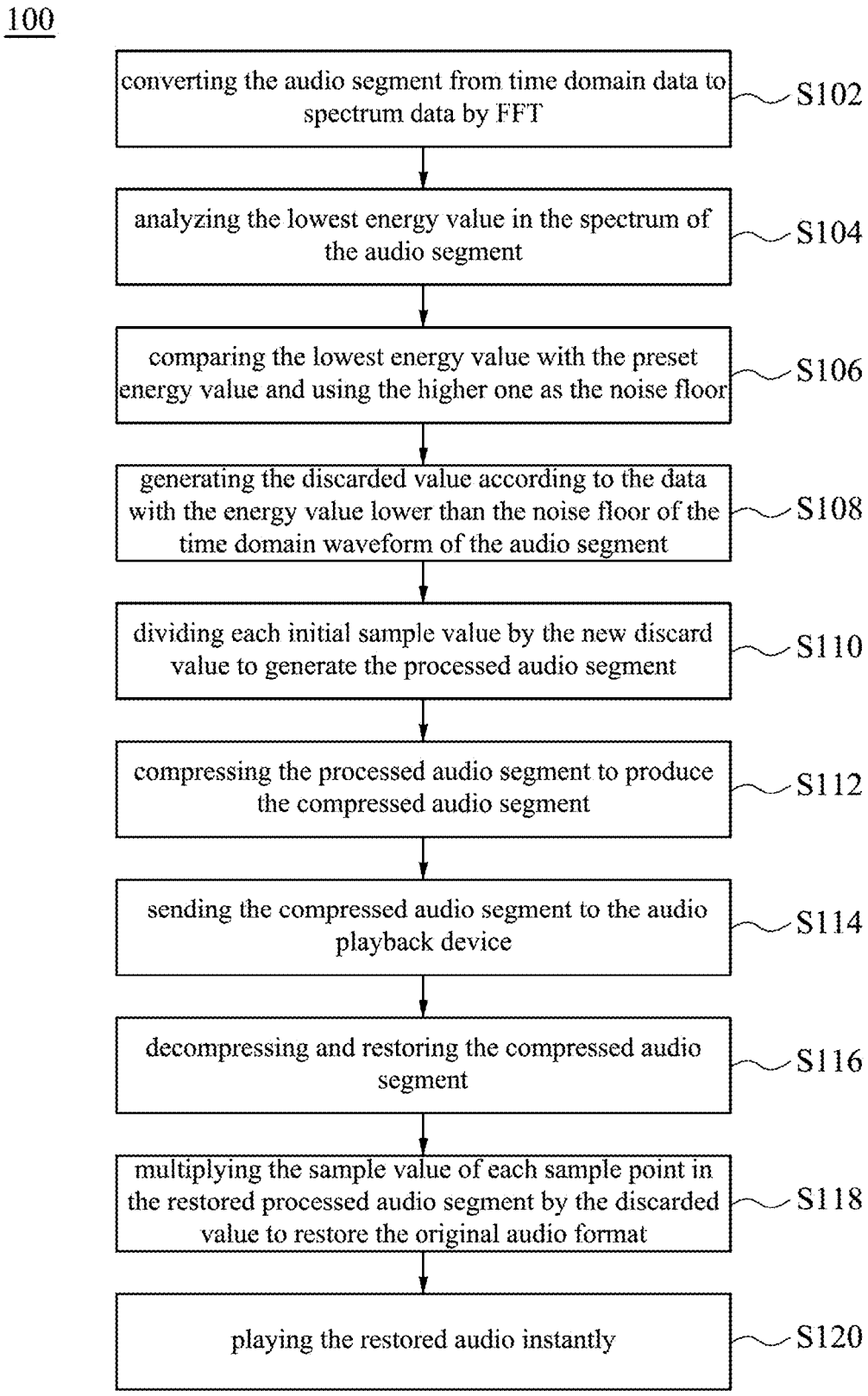
FIG. 1 is a flowchart illustrating an audio processing method according to some embodiments of the present disclosure.

The following disclosure provides many different embodiments, or examples, for implementing different features of the invention. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The terms used in this specification generally have their ordinary meanings in the art, within the context of the invention, and in the specific context where each term is used. Certain terms that are configured to describe the invention are discussed below, or elsewhere in the specification, to provide additional guidance to the practitioner regarding the description of the invention.

FIG. 1 is a flowchart illustrating an audio processing method 2 according to some embodiments of the present disclosure. The audio processing method 100 is configured to compress an audio file and send the compressed audio file to a playback device for playback. Preferably, when the audio file is large, the audio processing method 100 may divide the audio file into several audio segments, and may individually process each audio segment. Audio files may be divided according to any rules, such as length of time, number of sample points, and/or file size. The audio processing method 100 processes each audio segment according to the chronological order of the audio content, and the content of each audio segment has the same or different length of time, the number of sample points, and/or the file size, and the present disclosure is not limited there to.

The audio processing method 100 includes operations S102~S120. Among them, the operations S102 to S114 are executed by a device having a relatively high computational processing capability such as a computer, and the operations S116 to S120 are performed by a device having a low arithmetic processing capability such as a Bluetooth device. For example, the above computing processing capability refers to an operating parameter such as a clock rate of the processor, a performance of the processor, a floating-point computing capability, a bit bandwidth, a memory capacity, and the like. For example, a device with a higher arithmetic processing capability may include Sound systems, smart phones, tablet computers, portable music players, etc., and devices with lower computing and processing capabilities may include Bluetooth headsets, Bluetooth speakers, and the like.

The first audio segment of several audio segments in the audio file may be processed first through operations S102 to S120. After the first audio segment is processed by the audio processing method 100, the second audio segment is immediately processed through operations S102 to S120. After the second audio segment is processed, the next audio segment is executed. In other words, each audio segment is processed through operations S102 to S120 in sequence until the entire audio file is processed. Operations S102 to S110 are all pre-processing operations before compressing audio segments. In the following, only the first audio segment and the second audio segment are taken as an example to simplify the description.

Figure 2A:
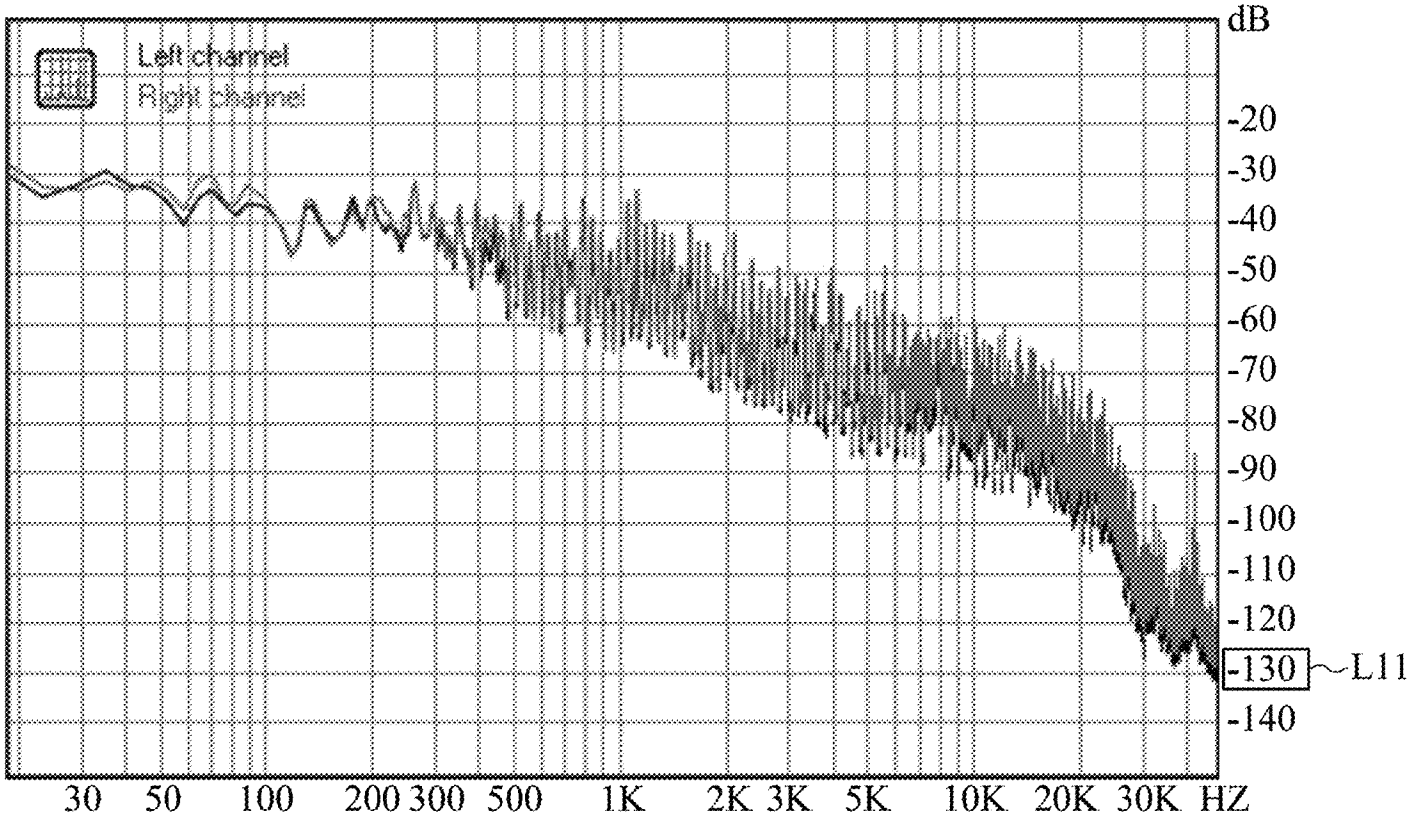
FIG. 2A to FIG. 2C is a spectrum diagram according to some embodiments of the present disclosure.

In operation S102, converting the first audio segment from time domain data to data (spectrum) represented in the frequency domain, and the above conversion may be performed through, for example, Fast Fourier Transform (FFT) or other similar calculations. The data is sample points in the time domain or frequency domain and corresponding sample value data. For the converted result, reference may be made to the spectrum of the first audio segment in an embodiment of the disclosure shown in FIG. 2A. In FIG. 2A, the horizontal axis coordinate unit is frequency (Hz) and the vertical axis is volume/energy (dB).

Next, in operation S104, analyzing the lowest energy value in the spectrum of the first audio segment. The purpose of this operation is to calculate the amount of data occupied by unnecessary system noise. For example, the audio output usually contains system-specific noise at each time. This system noise is generally referred to as a noise reference or a noise floor. The noise floor is undesired noise, which affects the signal-to-noise ratio (SNR), and the noise ratio is related to the quality of the audio signal. The noise floor is especially noticeable in the silence phase of audio, which also limits the dynamic range of audio (the ratio of the strongest volume to the weakest volume). Therefore, removing the amount of data occupied by system noise can not only reduce the file size, but also increase the compression capacity of the subsequent compression processing, and also improve the quality of the audio signal (increasing the SNR).

Figure 2B:
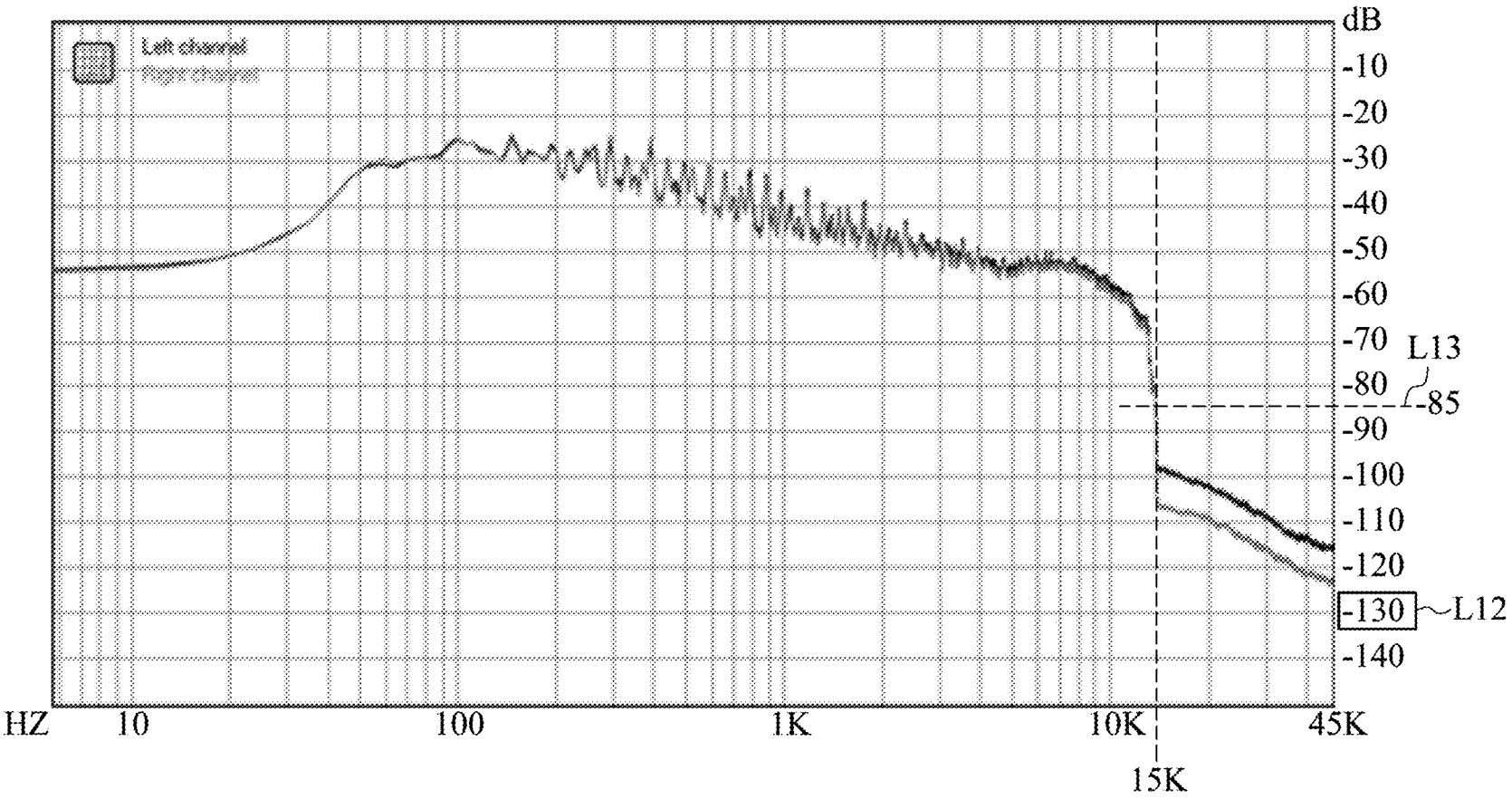

In operation S104, using the analyzed lowest energy value as the first lowest energy value. In the frequency spectrum of the embodiment of FIG. 2A, the first lowest energy value is approximately −130 dB at the energy value L11. In general, high frequency data usually have lower energy in a piece of audio content. It should be noted that the maximum range of the sound that the human ear can perceive on average is about 20 Hz to 20 KHz, but the perception of sounds above 15 KHz is very weak. Therefore, in a pop music record or some audio file, for example, the record company first removes the higher frequency (for example, 15 KHz or more) audio content in the audio file to reduce the file size, as shown in FIG. 2B. FIG. 2B illustrates a frequency spectrum diagram of audio content with a high frequency above 15 KHz in an embodiment of the disclosure. In other words, there is no useful information in the audio frequency above 15 KHz, leaving only useless information (noise). In FIG. 2B, the horizontal axis coordinate unit is frequency (Hz) and the vertical axis is volume/energy (dB).

In the embodiment of FIG. 2B, the first lowest energy value analyzed through operation S104 is located approximately at 45 KHz, which corresponds to the energy value L12 (−120 dB) indicated in the figure. However, in fact, in the embodiment shown in FIG. 2B, there is no effective audio file content in the audio signal segment above 15 KHz (which has been removed by the record company before delivery), that is, the range from 15 KHz to 45 KHz is the amount of data that unnecessary system noise occupies. Therefore, in operation S106 of the audio processing method 100, the first lowest energy value analyzed in operation S104 is compared with a preset energy value, and the higher noise is used as the first noise floor. Among them, in the disclosure document, the data below the energy value corresponding to the first noise floor is regarded as so-called noise. For example, if the minimum energy value analyzed in operation S104 is lower than the preset energy value, the preset energy value is used as the noise floor, and when the analyzed minimum energy value is higher than the preset energy value, the lowest energy value is used as a noise floor.

In the embodiment of FIG. 2B, the preset energy value corresponds to the energy value L13 (e.g. −85 dB). The preset energy value can also be set by the user. The present disclosure is not limited thereto. In this example, the preset energy value (−85 dB) is higher than the minimum energy value (−120 dB), so the preset energy value of −85 dB is used as the first noise floor, and the data lower than the energy value of the first noise floor of −85 dB is considered as noise.

The preset power value of −85 dB corresponds to the frequency of 15 KHz in FIG. 2B. Therefore, the portion of the range of 15 KHz to 45 KHz (corresponding to the lowest energy value frequency) can also be classified as miscellaneous by the setting of the preset energy value, and the portion of the range of 15 KHz to 45 KHz may not be left in error in error, and the ability to compress subsequent files may not be limited. In brief, by operation S106, the noise floor/unnecessary data closer to the actual audio can be calculated.

Figure 2C:
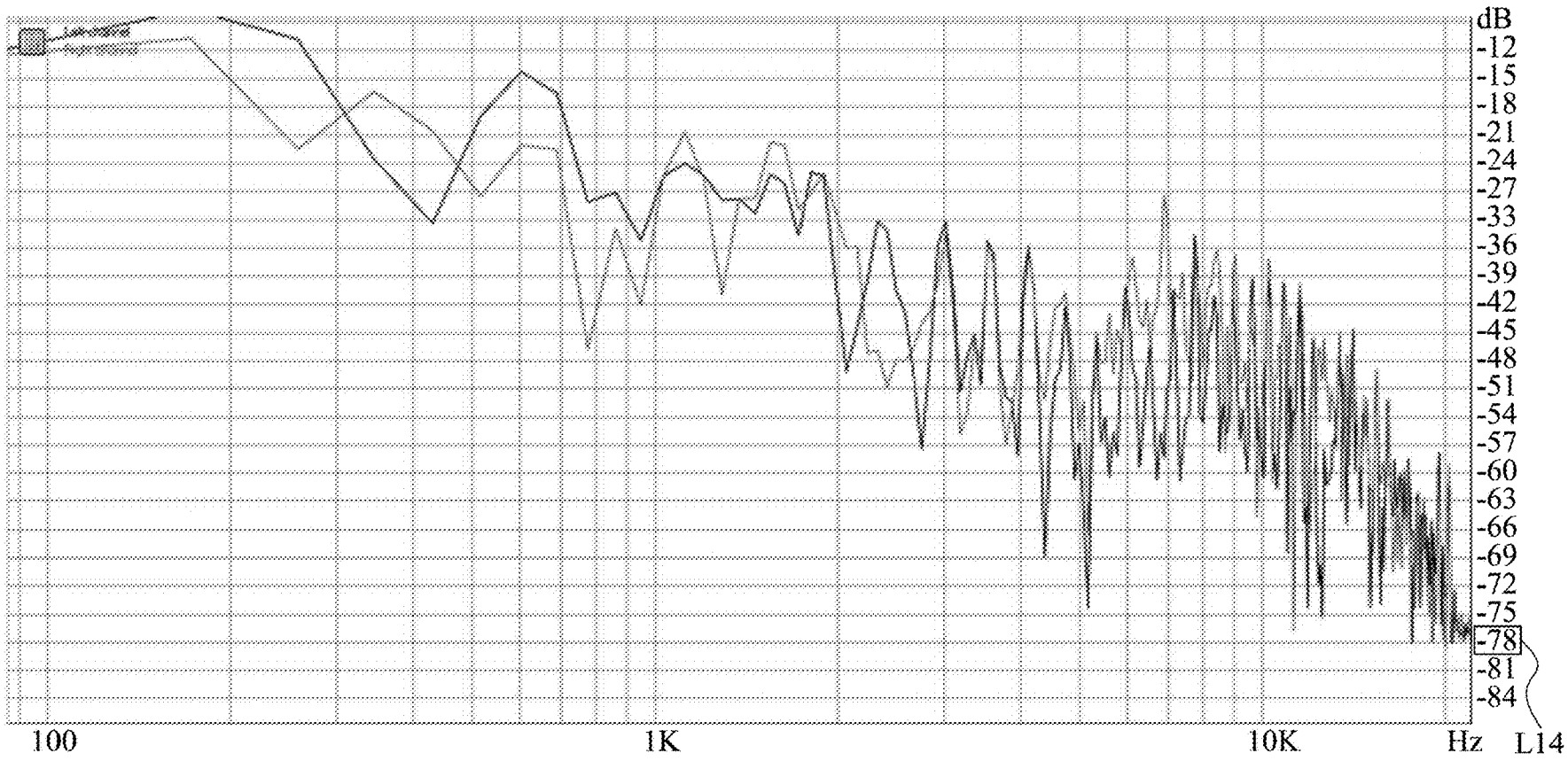

In another case, if the measured minimum energy value is higher than the preset energy value, the measured minimum energy value is used as the first noise floor. Reference is made to FIG. 2C. FIG. 2C illustrates a spectrum diagram of an embodiment of the present disclosure. In the frequency spectrum of the audio block shown in FIG. 2C, the lowest energy value L14 is approximately −78 dB, which is higher than the preset energy value (−85 dB). Therefore, the lowest energy value L14 is used as the first noise floor. By measuring the lowest energy value as the noise floor, the portion below the noise floor may be classified as noise data. In this way, the noise floor may be set floating with the lowest energy value of the audio content, and the noise floor does not fix to the preset energy value.

Next, in operation S108, the first discarded value is generated according to the data in the time domain waveform of the first audio segment that is lower than the first noise floor energy value. The first discarded value is used for further processing with the first audio segment to generate a first processed audio segment. Specifically, operation S108 calculates the amplitude of the time domain by performing a Root Mean Square (RMS) operation on the sample values of the time domain waveform of the first audio segment whose energy value is lower than the sample point of the first noise floor (Amplitude) and uses this magnitude as the first discarded value. Next, in operation S110, the initial sample values in the first audio segment are divided by the first discarded value, and after the decimal point is rounded off to the integer number, the first processed audio segment is generated. For example, the above-mentioned rounding off the decimal point may be realized by a floor function.

It is assumed that the first audio segment is an audio signal of 24 bit/96 KHz format, wherein the data range that can be represented by 24 bits has 8388608 different intensity levels, for example, it can be used to represent a value range of −8388608 to −1, or can be used to represent the value range of 0 to 8388607, or other set value range. The following examples are given using the numerical range of 0 to 8388607.

The initial sample value of one of the sample points in the time domain of the first audio segment is a maximum value of 8886607 that can be represented in the 24 bit format, assuming that the first discarded value is 1000. In operation S110, the value of the sample point 8398607 is divided by 1000 to obtain 8388.607, and the integer value is obtained by the floor function. The new sample value obtained is 8388. That is, after the sample point with the initial sample value of 8388607 in the original first audio segment is processed in operation S110, the sample value of the same sample point in the corresponding first processed audio segment is 8388.

Therefore, 24 bit/96 KHz format audio originally used 24 bits of data to store data for each sample point. After the pre-compression operation through operations S102~S110, the maximum initial sample value corresponds to a new one maximum sample value which is 8388 (between $2^{13}$ and $2^{14}$) and only 15 bits of data can be configured to store each sample point. In this way, the ability to compress audio later can be greatly improved. It should be noted that the traditional approach to noise floor is based on the number of bits. For example, when the first discarded value is 1000, since 1000 is between $2^9$ and $2^{10}$, only data amount of $2^9$(=512) can be discarded at most, in which discarded data amount of 1000−512=488 is wasted. In other words, the traditional practice may still retain unnecessary part of the noise, which leads to a decline in subsequent compression capabilities.

According to the above embodiment, when the sample value of a sample point is lower than the first discarded value, the new sample value will be 0. For example, assume that the sample value of one sample point in the time domain of the first audio segment is 900 (lower than the assumed first drop value of 1000). Through the processing of operation S110, the value 900 of this sample point is divided by 1000 to obtain 0.9, and the integer value is obtained by the floor function. The new sample value obtained is 0. That is, when the initial sample value in the original first audio segment is lower than the first discarded value, the new sample value in the corresponding first processed audio segment is 0 after being processed in operation S110.

Next, operation S112 compresses the first processed audio segment to generate a compressed audio segment. Specifically, the pre-processing operations of operations S102 to S110, the file size of the first audio segment has been greatly reduced, so operation S112 can use the distortion-free compression format to compress the first processed audio segment. There is no need to increase the compression capability through a distorted compression format. In this embodiment, the lossless compression format is, for example, Free Lossless Audio Codec (FLAC). With the FLAC compression technique, the sample point of the lowest sample value (for example, 0) in the first processed audio segment is discarded first to increase the compression capability, and the sample point of the lowest sample value is restored after the decompression to restore the original sample rate. If the first audio segment is directly compressed without being subjected to the preprocessing in operations S102 to S110, the compression ratio (compared between the compressed size and the size before compression) provided by the FLAC compression is approximately 70% to 80%, and after the preprocessing of operations S102 to S110 is performed, the compression rate can reach 20% to 15%.

After the first processed audio segment is compressed to generate a compressed audio segment, operation S114 sends the compressed audio segment to an audio playback device, such as a Bluetooth headset or Bluetooth speaker, via a Bluetooth transmission, for example, devices with low computing power. In operation S116, the audio playback device may decompress and restore the received compressed audio segments. Because the compressed audio segment is generated through processing without distortion compression (FLAC, for example), in the decompression process, only the sample point of the lowest sample value that was removed during the compression is needed (i.e. the first processed audio segment is restored) does not require additional complicated and extensive operations such as inverse fast Fourier transform.

After decompression and reduction, operation S118 multiplies the sample value of each sample point of the restored first processed audio segment by the first discarded value to restore the original audio format (e.g. 24 bits). Then, operation S120 immediately plays back the restored audio. Therefore, the audio processed by the audio processing method 100 can be quickly decompressed and restored by the audio playback device for immediate playback.

According to the above embodiment, after the first audio segment is processed by the audio processing method 100, the second audio segment is also processed through the audio processing method 100. Operation S102 first converts the time domain data of the second audio segment into spectrum. Operation S104 analyzes the second lowest energy value in the spectrum of the second audio segment. Operation S106 compares the second lowest energy value with the preset energy value, and uses the higher one as the second noise floor. In operation S108, the amplitude in the time domain is calculated by calculating the root mean square (RMS) of the sample value of the time domain waveform of the second audio segment in the time domain waveform that is lower than the sample point of the second noise floor. The magnitude of the amplitude is used as the second discarded value and is processed with the second audio segment in operation S110 to generate the second processed audio segment.

Next, operation S112 is performed to compress the second processed audio segment and operation S114 sends the compressed audio to the playback device, and the decompression and restoration processes of operations S116 and S118 are performed, and finally the audio is played in operation S120.

Figure 3A:
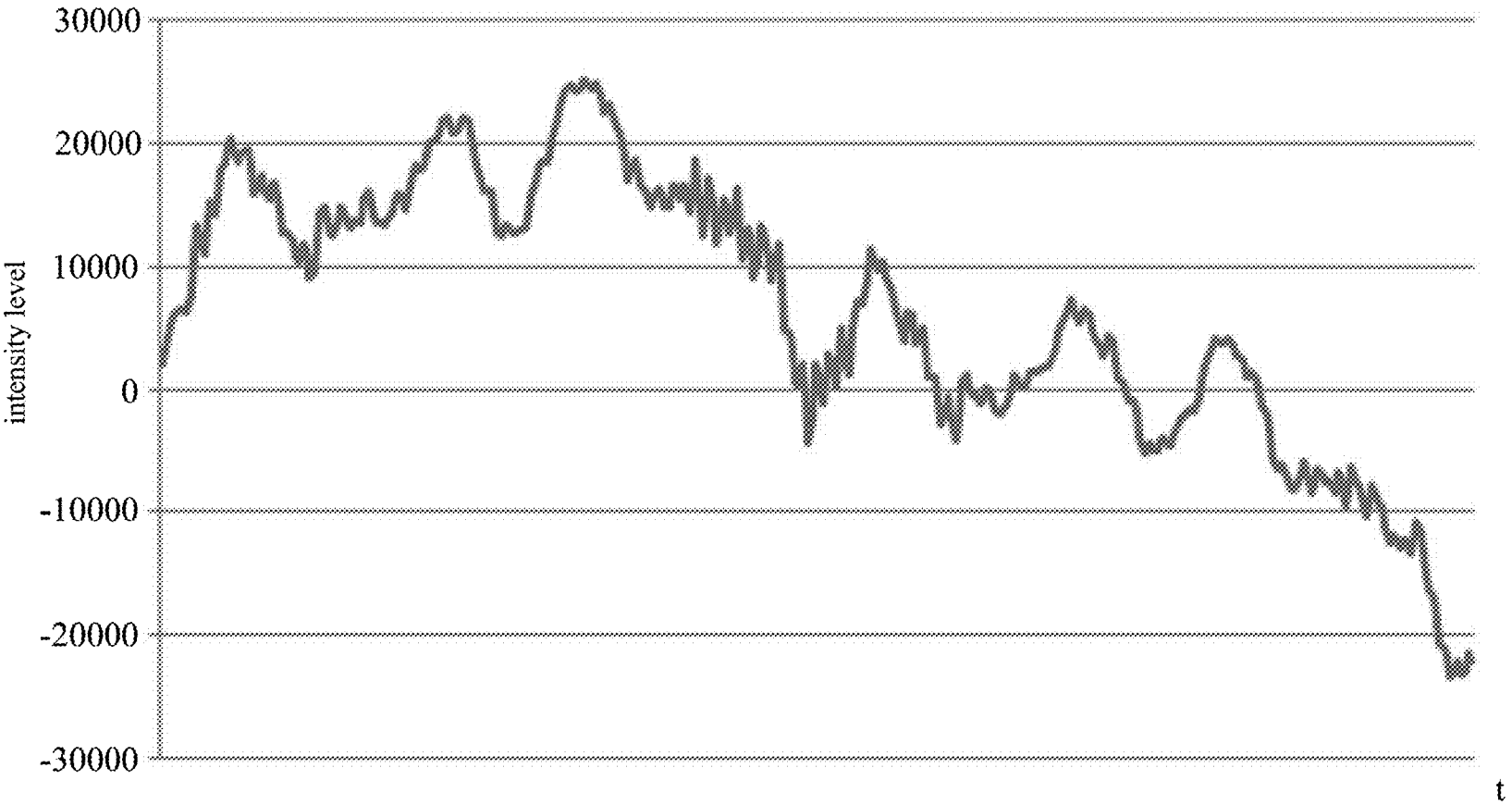
FIG. 3A to FIG. 3C is a time domain waveform according to some embodiments of the present disclosure.
Figure 3B:
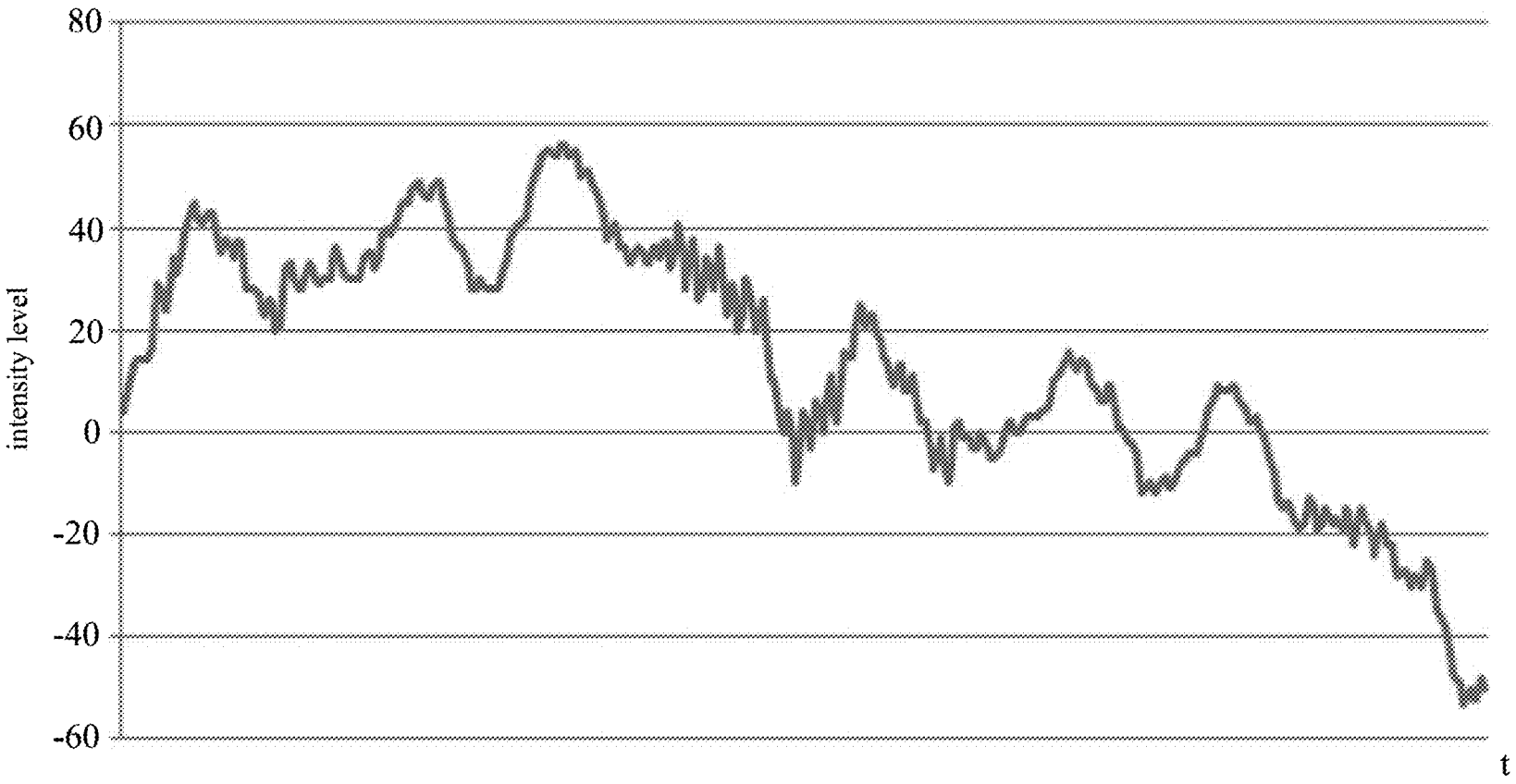
Figure 3C:
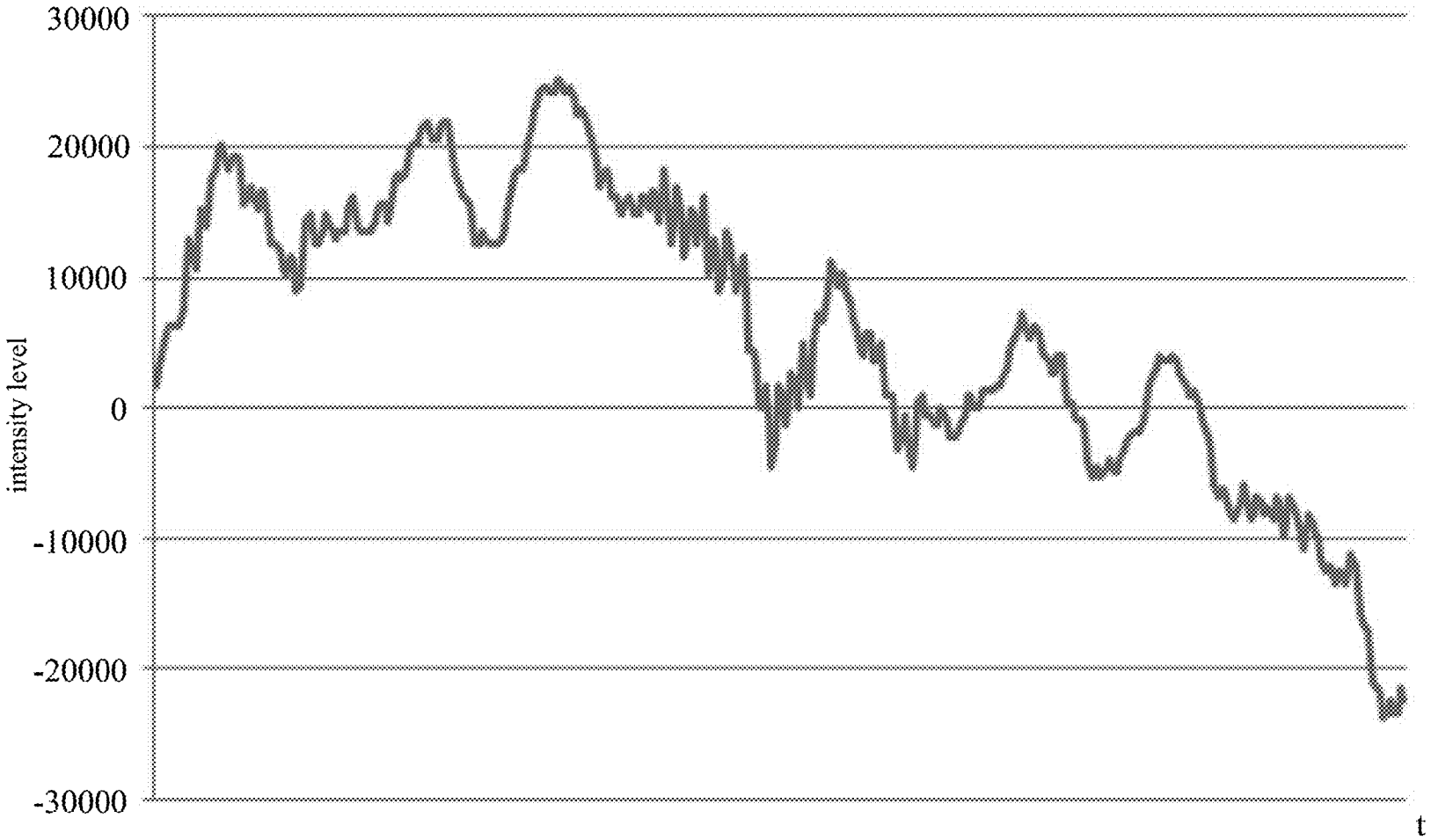

In an embodiment, the time domain waveforms of the audio segments processed by the audio processing method 100 are shown in FIG. 3A to FIG. 3C. Among them, in FIG. 3A to FIG. 3C, the abscissa axis unit is the time (t), and the ordinate axis unit is the intensity level, i.e., the sample value. FIG. 3A is a waveform diagram chart of an original time domain of an audio segment of an embodiment of the present disclosure. FIG. 3B is a time-domain waveform diagram of the processed audio segments generated by the preprocessing of operations S102 to S110 of the audio segment in the embodiment of FIG. 3A. In this example, it is assumed that the discarded value calculated in operation S108 is 448 to process the audio segment. FIG. 3C shows the time domain waveforms of the processed audio segments in FIG. 3B after being compressed in operation S112, sent in operation S114, and decompressed and restored in operations S115 to 118. As can be seen from FIG. 3A to FIG. 3C, no significant distortion occurs in the audio segments processed by the audio processing method 100.

Figure 4:
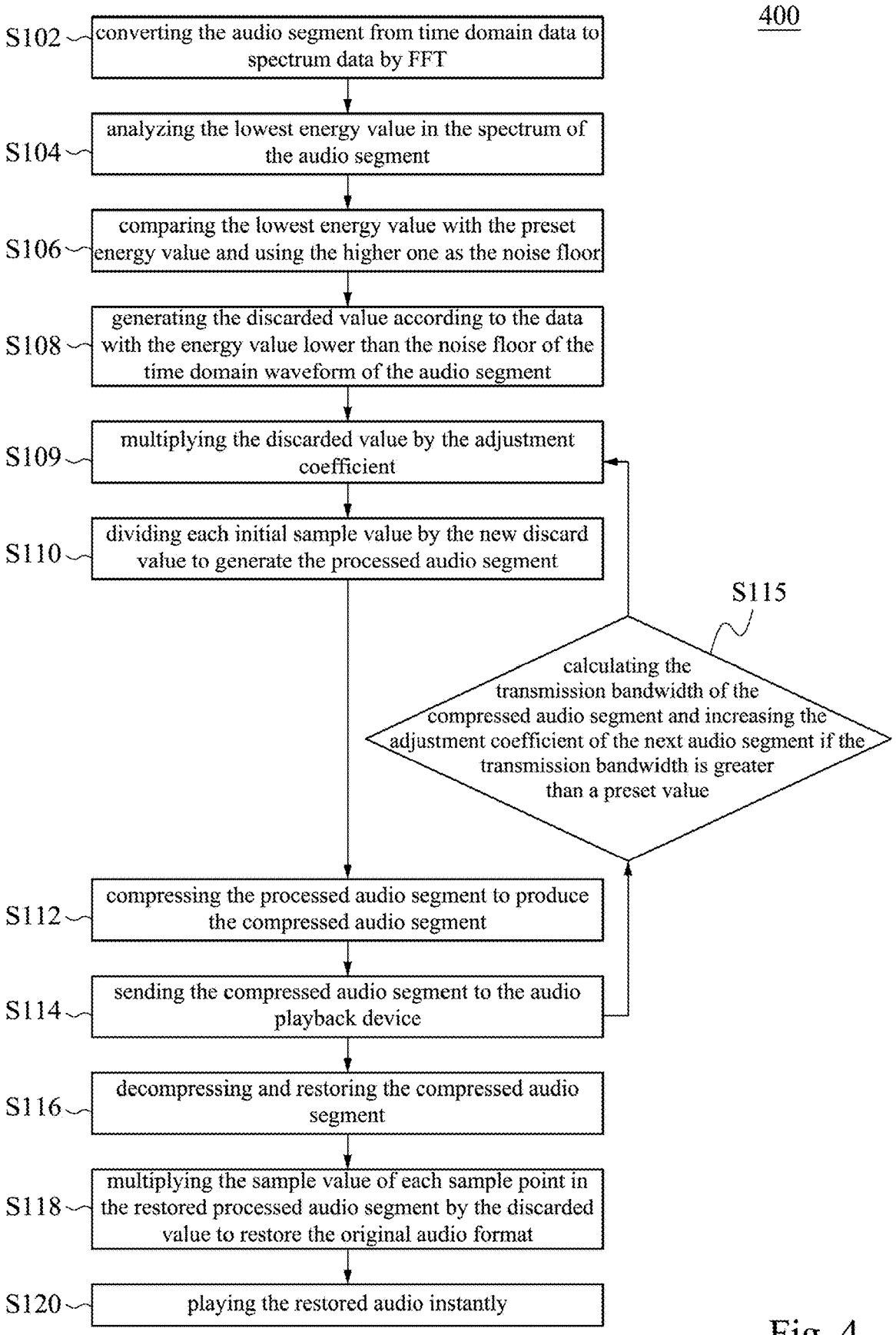
FIG. 4 is a flowchart illustrating an audio processing method according to some embodiments of the present disclosure.

In an embodiment of the present disclosure, the audio processing method may further include operation S109 and operation S115, as shown in FIG. 4. FIG. 4 is a flowchart of an audio processing method 400 according to an embodiment of the present disclosure. The audio processing method 400 includes operations S102, S104, S106, S108, S109, S110, S112, S114, S115, S116, S118, and S120. Operations S102 to S108, S110 to S114, and S116 to S120 are similar to the audio processing method 100. Reference is made to the relevant paragraphs above for explanation, which will not be repeated here. After generating the first discarded value in operation S108, in operation S109, the first discarded value is multiplied by an adjustment coefficient. Among them, the adjustment coefficient can be customized by the user to control and adjust the quality of the audio file generated in the subsequent processing operations.

In more detail, the user can determine that the audio file does not require too high quality, one can choose to increase the first discarded value, so that the amount of data to be discarded to increase, thereby reducing the size of the audio file, the subsequent compression capability can be further promoted. For example, suppose the first discarded value is 1000 and the adjustment coefficient is 16, then in operation S109, the first discarded value 1000 is multiplied by an adjustment coefficient of 16, and the product is the new discarded value 16000, that is, the discarded value is increased. Then, proceeding to operation S110, the initial sample values in the first audio segment are divided by the new discarded value and processed by the floor function to generate the first processed audio segment. Then, after the first processed audio zone is compressed to generate a compressed audio segment in operation S112, the compressed audio segment is transmitted to the audio playback device in operation S114.

In operation S115, calculating the transmission bandwidth of the compressed audio segment. If the transmission bandwidth is greater than a preset value, the adjustment coefficient of the next audio segment (second audio segment) is increased. In general, in order to enable Bluetooth to transmit data stably, usually the bandwidth is required to be between 1 and 1.5 Mbps or less. In this embodiment, the default value is set to be 660 Kbps. When the bandwidth of the compressed audio segment is greater than the preset value, the adjustment coefficient of the second audio segment is automatically increased, thereby increasing the discarded value to improve the compression capability. Due to the improvement of the adjustment coefficient, the transmission bandwidth of the subsequently compressed audio segments will meet the conditions for stable transmission (less than 660 Kbps).

It should be understood that, when the transmission bandwidth is much smaller than a preset value, the adjustment coefficient of the second audio segment may also be reduced to increase the bandwidth. The value of the adjustment coefficient may be an integer/non-integer or even a functional formula, and the disclosure is not limited thereto. In an embodiment, the system or user can also establish an adjustment coefficient table in advance. The adjustment coefficient table includes a plurality of different adjustment coefficients. Therefore, in operation S115, the audio processing method 400 may automatically select larger or smaller adjustment coefficients in the adjustment coefficient table when the transmission bandwidth is greater than or much less than a preset value, so as to process the next audio segment.

Figure 5:
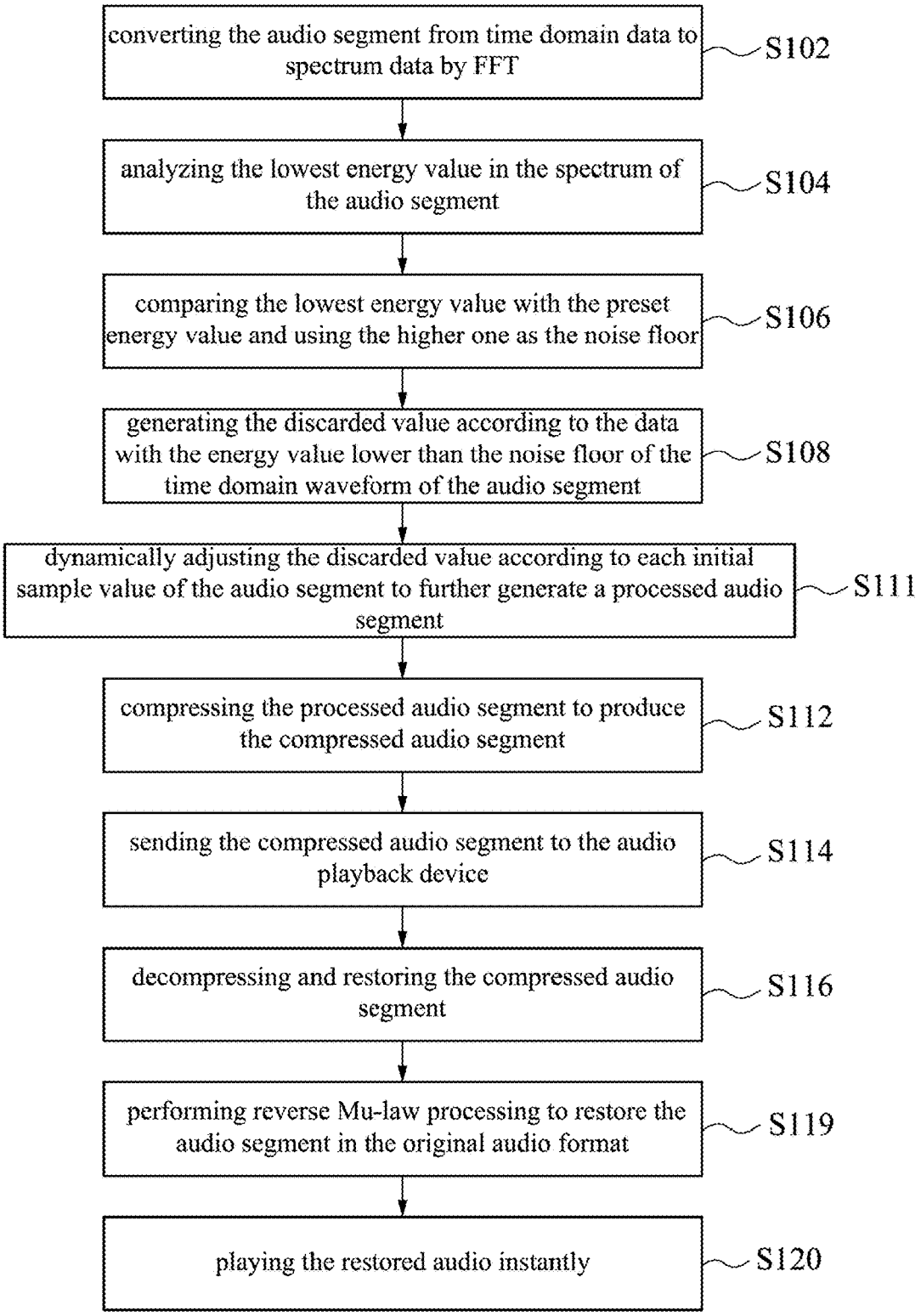
FIG. 5 is a flowchart illustrating an audio processing method according to some embodiments of the present disclosure.

In another embodiment of the present disclosure, the audio processing method may also include operations S111 and S119. FIG. 5 is a flowchart of an audio processing method 500 according to some embodiments of the present disclosure. The audio processing method 500 includes operations S102, S104, S106, S108, S111, S112, S114, S116, S119, and S120. Operations S102 to S108, S112 to S116, and S120 are the same as the audio processing method 100. Reference is made to the foregoing paragraphs for explanation, and may not be repeated here. In operation S111, the first discarded value generated in operation S108 is dynamically adjusted according to the size of each initial sample value in the first audio segment to further generate a processed audio segment. That is, the sample value of each sample point is adjusted according to the corresponding first rejection value. The first discarded value and each initial sample value of the first audio segment are converted by a non-linear companding method to correspondingly adjust each initial sample value and generate a new sample value.

Figure 6:
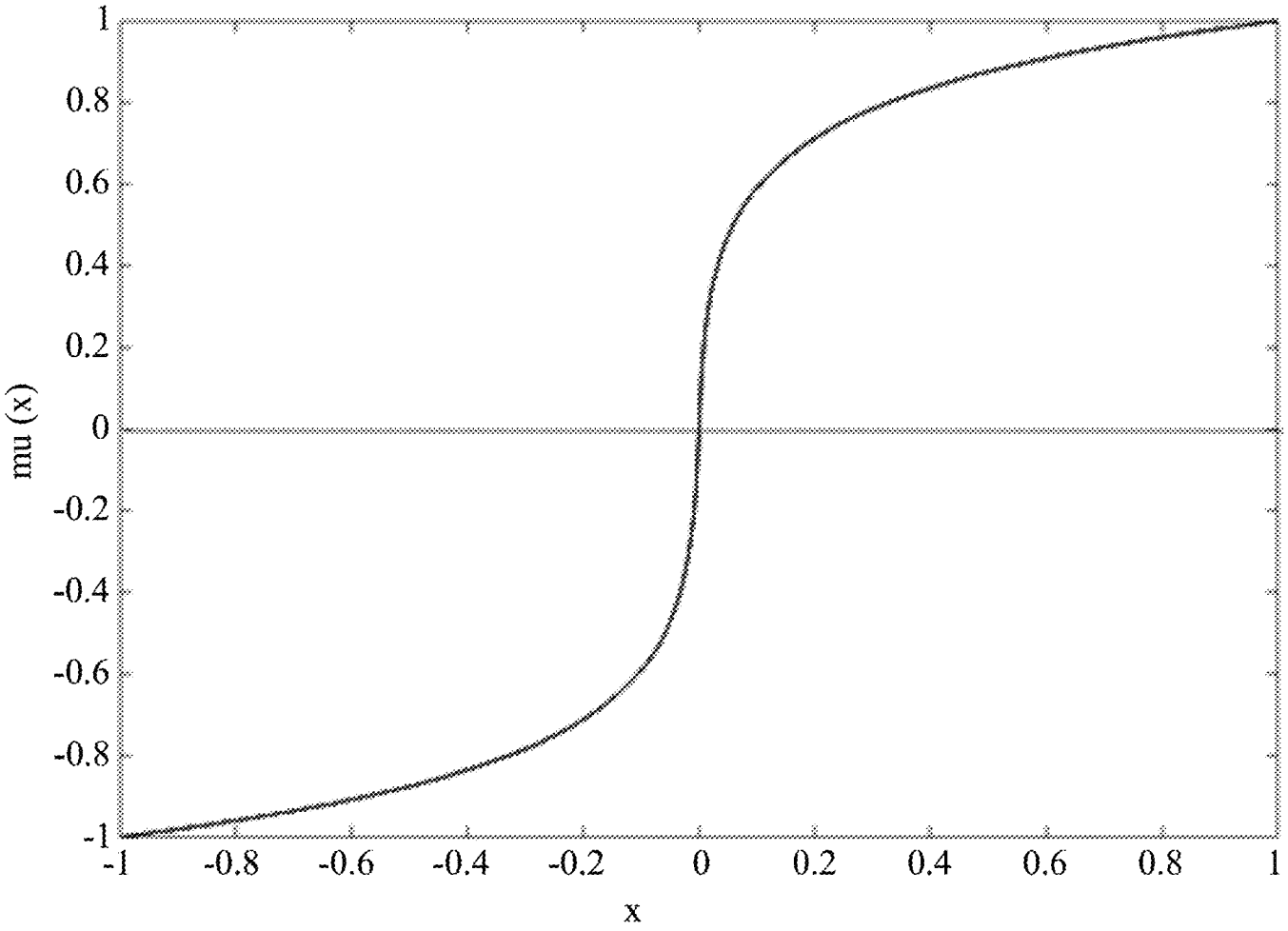
FIG. 6 is a function graph according to some embodiments of the present disclosure.

In an embodiment, the non-linear companding method may be, for example, Mu-law encoding. In Mu-law coding, the interval of the initial sample value corresponds to the interval with the maximum value of 1 and the minimum value of −1, that is, the sample value is divided by the maximum value. The Mu-law function (μ-law function) is as follows:

$$mu(x) = \text{sign}(x)\left(\frac{\ln(1+\mu|x|)}{\ln(1+\mu)}\right)$$

x is a sample value, μ is a discarded value, sign(x) is a sign function, and when x is greater than 0, sign(x)=1; when x is 0, sign(x)=0; and when x is less than 0, sign(x)=−1. The value of mu(x) is set between 1 and −1. Therefore, the calculated value of mu(x) must be multiplied by the number of bits in the converted audio format to obtain the actual corresponding sample value. For the relationship between the mu-law coding function mu(x) and the sample value x, reference is made to the Mu-law coding function graph of an embodiment of the present disclosure shown in FIG. 6. In FIG. 5, the x-axis represents the abscissa and mu (x) represents the ordinate.

For example, assuming that the first audio segment is in a 16 bit/44.1 KHz format, when the discarded value μ is 255, after processing by operation S111, the data amount of the first audio segment is converted to 8 bits. If there is a sample point with a sample value of 33, after Mu-law encoding conversion, mu(33/32768)=0.0412 is obtained, and the data volume of the first audio segment is converted into 8 bits after processing, so 0.0412 is multiplied by the $2^7$ (=128), and through the floor function, 5 is obtained. That is to say, sample points with a sample value of 33 are encoded by Mu-law and correspond to the sample value 5 in the 8 bit format. Alternatively, assume there is another sample point with a sample value of 32178, after the Mu-law encoding conversion, mu(32178/32768)=0.9967 is obtained, then multiplying 0.9967 by 128, with the use of the floor function, 127 is obtained. That is, the sample point with the sample value of 32178 is encoded by Mu-law and corresponds to the sample value 127 in the 8-bit format.

By processing the discarded values through Mu-law encoding, even small sample points can be retained, so that the dynamic range of the audio segment is preserved, and the audio quality does not lost too much due to the processing of noise. It should be understood that the audio processing method 500 may use different non-linear companding techniques according to practical applications. This document only uses Mu-law coding as a preferred embodiment, but the present disclosure is not limited thereto.

After operation S111 is completed, operation S112 is performed to compress the file and operation S114 is performed to send the compressed audio segment to the audio playback device. The audio playback device decompresses the compressed audio segment to restore to the original processed audio segment in operation S116. Then, in operation S119, reverse Mu-law processing is performed to restore the audio segments into the original audio format. Among them, the inverse Mu-law function (inverse law function) is as follows:

$$\mu\ \text{inverse}(x) = \text{sign}(x)\left(\frac{(\mu+1)^{|x|}-1}{\mu}\right)$$

Taking the sample point of the above sample value 33 after the Mu-law encoding corresponds to the sample value 5 in the 8 bit format as an example, the sample value 5 is to be substituted into the inverse Mu-law function, and mu_inverse(5/128)=0.00094846 may be obtained. Since the original data volume of the first audio segment is 16 bits, multiplying 0.00094846 by $2^{15}$ (=32768), and perform an unconditional decimal point carry to obtain 32, in which only about 3% error exists comparing to the original sample value 33. For example, the above-mentioned decimal point unconditional carry may be accomplished by a ceiling function. For example, after the sample point with the above sampling value of 32178 is encoded by Mu-law and corresponds to the sampling value in the 8 bit format, substituting the sample value 127 into the inverse Mu-law function, and mu_inverse(127/128)=0.9574 is obtained. Multiplying 0.9574 by 215, and processing the rounding function to obtain 31373, in which only about 2.5% error exists comparing to the original sample value of 32178.

In an embodiment of the present disclosure, operations in the audio processing methods 100, 400, and 500 may also be integrated to implement or change the execution sequence. For example, an audio processing method may also include operations S109 and S115 of the audio processing method 400, and operations S111 and S119 of the audio processing method 500 at the same time. Specifically, the first discarded value may be multiplied by the adjustment coefficient to generate a new discarded value in operation S109 of the audio processing method 400, and then the first audio segment and the new discarded value are substituted into operation S111 of the audio processing method 500 to produces a first processed audio segment through the linear companding technique. Then, after being compressed and transmitted, in operation S115, the transmission bandwidth of the compressed audio segment is calculated to determine whether there is a need to increase the adjustment coefficient of the next audio segment.

In one aspect of the disclosure, the audio processing method described above may be implemented via a non-transitory computer readable medium. The non-transitory computer readable medium stores a plurality of code instructions. When the plurality of code instructions are executed by the processing unit, operations S102, S104, S106, S108, S109, S110, S111, S112, S114, S115 in the audio processing methods 100, 400, and 500, or the integration method of these operations can be performed. The non-transitory computer readable medium may be a computer, a mobile phone, or an independent audio encoder, and the processing unit may be a processor or a system chip.

In another embodiment of the disclosure, another non-transitory computer readable medium also stores a plurality of code instructions. When the plurality of code instructions are executed by the processing unit, the operations S116, S118, S119, and S120 of the audio processing method 100, 400 and 500 can be performed. The other non-transitory computer readable medium may be an audio playback device such as a Bluetooth/wireless headset, a speaker, an audio, or an independent audio decoder. The processing unit may be a microprocessor or a system chip.

Through the teachings of the disclosure document, even if an audio file uses a high-resolution format of 24 bit/96 KHz, the audio file may be transmitted through a low transmission bandwidth specification such as Bluetooth after compression, and can be instantly played on an audio playback device.

In this document, the term "coupled" may also be termed as "electrically coupled", and the term "connected" may be termed as "electrically connected". "Coupled" and "connected" may also be configured to indicate that two or more elements cooperate or interact with each other. It will be understood that, although the terms "first," "second," etc., may be used herein to describe various elements, these elements should not be limited by these terms. These terms are configured to distinguish one element from another. For example, a first element could be termed a second element, and, similarly, a second element could be termed a first element, without departing from the scope of the embodiments. As used herein, the term "and/or" includes any and all combinations of one or more of the associated listed items.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An audio processing method, comprising:

dividing an audio file into a plurality of audio segments, wherein a processing of a first audio segment of the audio segments comprises the following operations:

analyzing a first lowest energy value in a spectrum of the first audio segment;

comparing the first minimum energy value with a preset energy value, and using a higher energy value of the first minimum energy value and the preset energy value to be a first noise floor;

generating a first processed audio segment according to the first noise floor and the first audio segment, wherein the operation of generating the first processed audio segment further comprises:

performing a root mean square operation on a sample value of at least one sample point at enemy values of a time domain waveform of the first audio segment, in order to generate a first discarded value, wherein the enemy values are lower than the first noise floor; and dividing each of a plurality of initial sample values in the first audio segment by the first discarded value to generate the first processed audio segment;

compressing the first processed audio segment to produce a compressed audio segment; and sending the compressed audio segment to an audio playback device.

2. The audio processing method of claim 1, wherein the operation of generating the first processed audio segment further comprises:

adjusting each of the plurality of initial sample values correspondingly according to the first discarded value and each of the plurality of initial sample values in the first audio segment.

3. The audio processing method of claim 1, further comprising:

analyzing a second lowest energy value in a spectrum of a second audio segment, wherein the second audio segment is sent after the first audio segment;

comparing the second lowest energy value with the preset energy value, and using a higher energy value of the second lowest energy value and the preset energy value to be a second noise floor;

performing a root mean square operation on a sample value of at least one sample point at energy values of a time domain waveform of the second audio segment, in order to generate a second discarded value, wherein the energy values are lower than the second noise floor; and adjusting the second audio segment of the second discarded value when a bit rate of the compressed audio segment sent to the audio playback device is greater than a preset value.

4. The audio processing method of claim 3, further comprising:

multiplying the second discarded value by an adjustment coefficient when the bit rate of the compressed audio segment sent to the audio playback device is greater than the preset value; and adjusting a plurality of initial sample values of the second audio segment according to a product of the second discarded value and the adjustment coefficient, so as to generate a second processed audio segment.

5. The audio processing method of claim 1, wherein the audio playback device is a Bluetooth device, and sending the compressed audio segment to the audio playback device is transmitted through Bluetooth.

6. The audio processing method of claim 1, wherein an operation of compressing the processed audio segments is a distortionless compression.

7. A non-transitory computer readable medium storing a plurality of instructions, wherein when the instructions are executed by a processing unit, a plurality of operations as following are executed:

dividing an audio file into a plurality of audio segments, wherein a processing of one of the audio segments comprises the following operations:

analyzing a lowest energy value in a spectrum of the one of the audio segments;

comparing the first minimum energy value with a preset energy value and using a higher one as a noise floor;

generating a processed audio segment according to the noise floor and the one of the audio segments, wherein the operation of generating the processed audio segment further comprises: performing a root mean square operation on a sample value of at least one sample point at energy values of a time domain waveform of the one of the audio segments, in order to generate a discarded value, wherein the energy values are lower than the noise floor; and dividing each of a plurality of initial sample values in the one of the audio segments by the discarded value to generate the processed audio segment;

compressing the processed audio segment to produce a compressed audio segment; and sending the compressed audio segment to an audio playback device.

* * * * *